United States Patent [19]

Winkler et al.

[11] Patent Number: 4,833,969

[45] Date of Patent: May 30, 1989

[54] LOADING DEVICE FOR A TUBULAR WEAPON

[75] Inventors: Gert Winkler, Meerbusch; Erich Zielinski, Düsseldorf; Adolf P. Bierwirth, Kaarst, all of Fed. Rep. of Germany

[73] Assignee: Rheinmetall GmbH, Düsseldorf, Fed. Rep. of Germany

[21] Appl. No.: 146,698

[22] Filed: Jan. 21, 1988

[30] Foreign Application Priority Data

Jan. 22, 1987 [DE] Fed. Rep. of Germany ..... 3701712

[51] Int. Cl.[4] ..... F41F 9/06

[52] U.S. Cl. ..... 89/36.13; 89/45; 89/47

[58] Field of Search ..... 89/36.13, 45, 47

[56] References Cited

U.S. PATENT DOCUMENTS 457,293 8/1891 Spiller ..... 89/47

4,727,790 3/1988 DeHaven et al. ..... 89/47

FOREIGN PATENT DOCUMENTS 3046642 7/1982 Fed. Rep. of Germany ..... 89/47

3113027 10/1982 Fed. Rep. of Germany .

*Primary Examiner*—Stephen C. Bentley

*Attorney, Agent, or Firm*—Spencer & Frank

[57] ABSTRACT

A loading device for a tubular weapon includes two adjacent belt magazines; a separate loading tray cooperating with each magazine and being arranged for pivotal motion about 90° from a cartridge-receiving position into a loading position in alignment with the tubular weapon; a common partition wall forming part of the two magazines and being arranged between the discharge sides of the magazines and the tubular weapon; at least one partition door provided in the partition wall; separate drive chains supported along the discharge side of each magazine and being connected to a respective loading tray for displacing the loading tray; a separate linear guide being in guiding engagement with each loading tray; and a separate curved guide extending generally along the discharge side of the respective magazine and being bent theretoward. The linear guide and the curved guide together guiding the respective loading tray from one of its positions to the other of its positions when displaced by the drive chain.

11 Claims, 4 Drawing Sheets

LOADING DEVICE FOR A TUBULAR WEAPON

BACKGROUND OF THE INVENTION

The present invention relates to a loading device for a tubular weapon. The device is of the type in which two adjacent belt magazines hold the cartridges in readiness such that the tips of the cartridges in one belt are oriented to the tips of the cartridges in the other belt. Between the two belts a rammer is provided which is displaceable toward and away from the tubular weapon. With each belt magazine there is associated a loading tray which may be swung 90° from a receiving position next to the associated belt magazine into alignment with the tubular weapon. Each loading tray has an outer end which is guided along the discharge side of the associated belt magazine.

A loading device of the above-outlined type is disclosed in German Offenlegungsschrift (non-examined Published Application) 3,046,642. This device includes a loading tray which, in order to receive a cartridge, is pivoted by means of a pivot arm into the vicinity of an associated magazine half and, after receiving the cartridge, is brought into alignment with the tubular weapon. The loading tray includes a roller which is guided in a linear rail fixed to the turret. The roller is attached to the outer end of the loading tray, while the pivot arm is articulated at the inner end thereof, relative to the transfer position at the magazine. This arrangement, however, does not provide sufficient protection of the crew chamber against the cartridges held on the loading tray. The pivoting device is not adapted to introduce even at least partially the cartridge into the breech during the course of the pivotal motion.

SUMMARY OF THE INVENTION

It is an object of the present invention to provide an improved loading device of the above-outlined type which makes it possible to protect the crew chamber against the magazines during the loading process and to reduce the distance between the magazines and the breech of the weapon.

This object and others to become apparent as the specification progresses, are accomplished by the invention, according to which, briefly stated, the loading device for a tubular weapon includes two adjacent belt magazines; a separate loading tray cooperating with each magazine and being arranged for pivotal motion about 90° from a cartridge-receiving position into a loading position in alignment with the tubular weapon; a common partition wall forming part of the two magazines and being arranged between the discharge sides of the magazines and the tubular weapon; at least one partition door provided in the partition wall; separate drive chains supported along the discharge side of each magazine and being connected to a respective loading tray for displacing the loading tray; a separate linear guide being in guiding engagement with each loading tray; and a separate curved guide extending generally along the discharge side of the respective magazine and being bent theretoward. The linear guide and the curved guide together guiding the respective loading tray from one of its positions to the other of its positions when displaced by the drive chain.

The invention achieves that the magazines are separated from the crew chamber by means of a partition. The loading tray is—when the partition door is shut—disposed on the side of the partition facing away from the tubular weapon, similarly to the rammer as well as the associated guides and at least some of the drives. During the loading process, the partition door is automatically opened and after retraction of the rammer and the loading tray, the door is closed again until the next loading process. The structure of the loading device is space saving, simple and robust.

DESCRIPTION OF THE PREFERRED EMBODIMENTS

Figure 1:
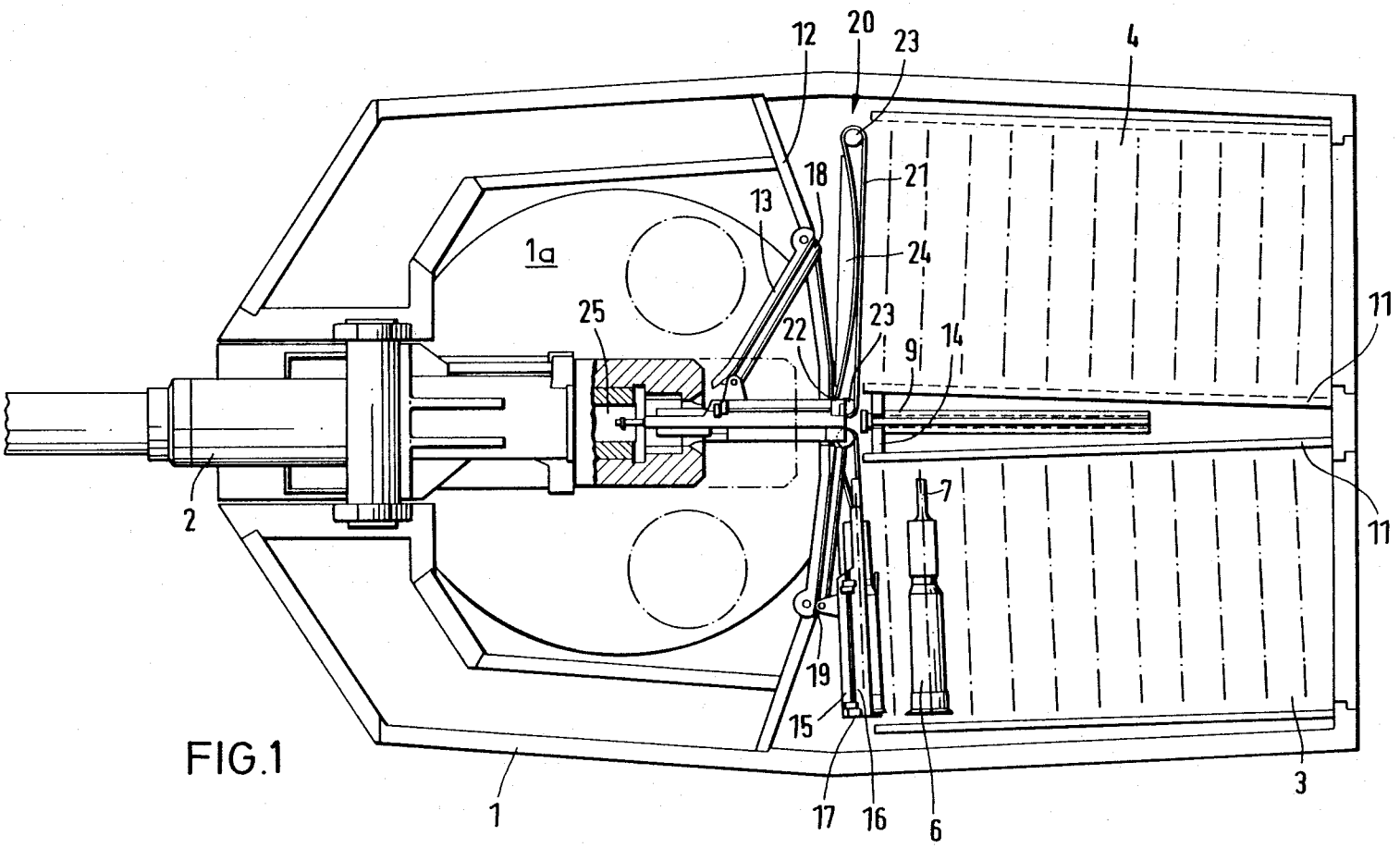
FIG. 1 is a schematic top plan view of the flat turret of a tank weapon, including a loading device according to a preferred embodiment of the invention.
Figure 2:
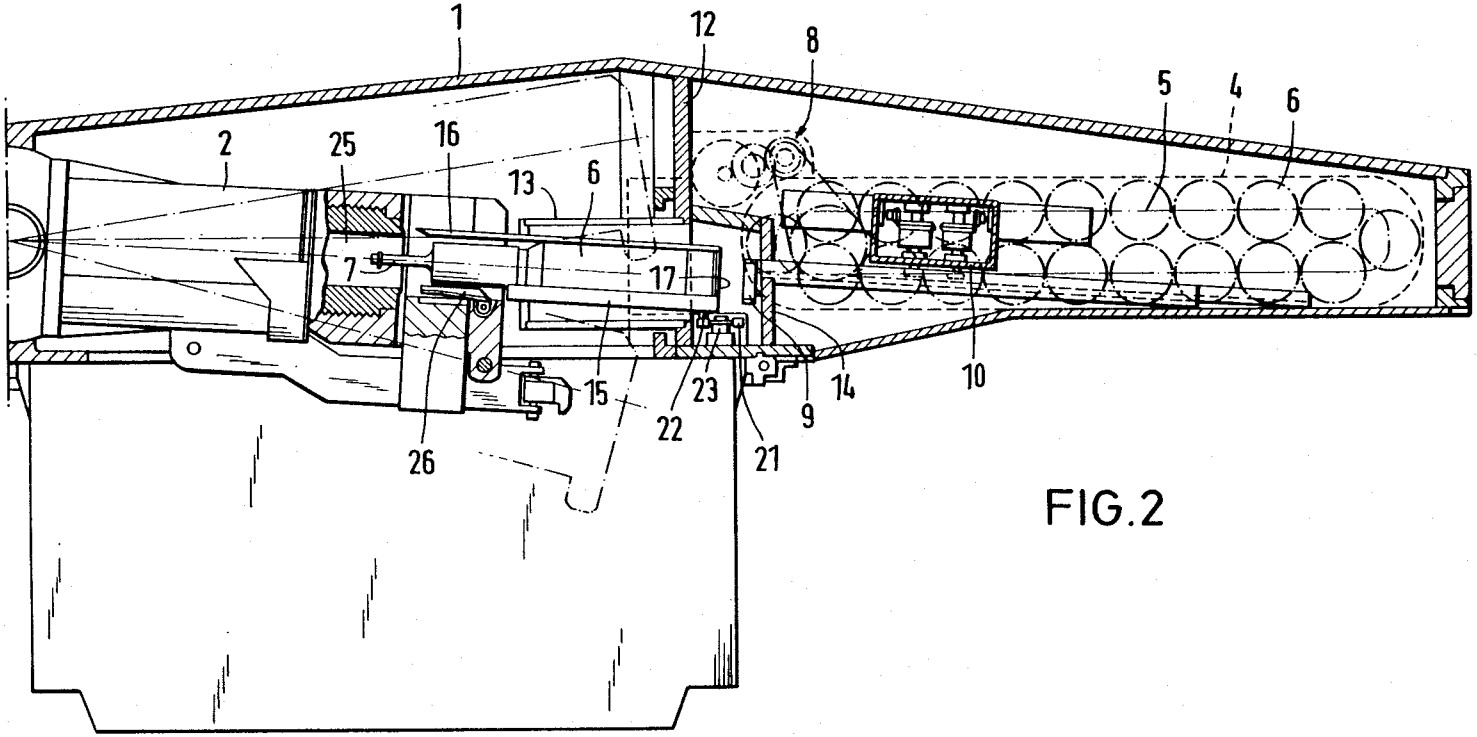
FIG. 2 is a sectional side elevational view of the structure of FIG. 1.

Turning to FIGS. 1 and 2, there is shown a flat turret 1 of a combat tank. The turret 1 accommodates a tubular weapon 2 in front, as well as two belt magazines 3 and 4 in its rear region. Belt magazines 3 and 4—which form part of a loading device according to the invention—are equipped with magazine belts 5, including ammunition holding elements which receive cartridges 6 in such a manner that the tips 7 of the cartridges 6 of both belt magazines 3 and 4 face one another and the cartridges 6 are released outwardly at the points of reversal of magazine belts 5. In this manner, the ammunition can be removed at the inner location of reversal —after a flap is opened which otherwise serves as a guide—while at the outer location of reversal the ammunition is guided by a fixed tray. The magazine belts 5 are coupled to drives 8. The two belt magazines 3 and 4 are spaced from one another and are divergent slightly in the direction of the tubular weapon 2 so as to receive a rammer 9 between themselves. The rammer 9—which may be of telescoping structure—is displaceable by a drive 10 in the direction toward the tubular weapon 2.

Belt magazines 3 and 4 are provided with partitions 11 on both sides and a common partition wall 12 situated between the crew chamber 1*a* on the one hand and the cartridge release (discharge) side of the two belt magazines 3, 4, on the other hand. The partition wall is provided with two adjacent partition doors 13. The belt magazines 3 and 4 are thus protectively separated from the crew chamber 1*a*. In the center region of partition wall 12 an additional partition 14 is provided which has an opening for allowing passage of the rammer 9.

A loading tray 15 is provided for each belt magazine 3, 4 to take over the ammunition to be loaded from the respective magazine belt 5, after the latter has brought the selected type of ammunition into the transfer position in the reversal region of the lower and upper reach of magazine belt 5 adjacent to tubular weapon 2 and after the ammunition has been released. In such takeover position the loading tray 15 is disposed parallel to the longitudinal axes of cartridges 6 held in the respective magazine.

The loading tray 15 is preferably a half shell equipped with a resiliently tensioned articulated clamp 16 for gripping a major part of the circumference of cartridge 6. Additionally, the loading tray 15 is provided with a bottom section 17 which permits passage of the rammer 9 and which serves as a support for the base of the cartridge 6 to be loaded.

Partition doors 13 are articulated to the partition wall 12 to be pivotal toward the tubular weapon 2. On the side facing belt magazines 3, 4, the partition doors 13 are provided with a guide rail 18 which serves as a straight guide and cooperates with a roller 19 supported by the loading tray 15 at a lateral, center region thereof. Further, for each loading tray 15 a chain drive 20 is provided, whose chain 21 is connected with the rear end of the loading tray 15 by a rotary or ball pin 22 (laterally of the longitudinal axis of the loading tray 15 toward the partition door 13). The chains 21 are trained around sprockets 23. The outer sprockets are driven by a drive (not shown), while the inner sprockets are disposed adjacent one another symmetrically to the center plane extending between the belt magazines 3 and 4. The chain reach oriented toward the tubular weapon 2 is guided along a guide member 24 shaped approximately as a circular segment.

When the loading tray 15 has taken over the desired ammunition in the transfer position, the chain drive 20 guides the end of the loading tray 15, which is articulated to the chain 21, along the guide member 24. At the same time, by virtue of the fact that the center region of the loading tray is in engagement, via the roller 19, with the guide rail 18 of the partition 13, the partition door 13 is opened and the loading tray 15 is pivoted in the direction toward the tubular weapon 2 until the longitudinal axis of the loading tray 15 is aligned with the longitudinal axis of tubular weapon 2 (which, for this purpose, must be disposed in an index position). Upon completion of this pivoting movement, the rammer 9 advances and pushes cartridge 6 into the load chamber 25 of the tubular weapon 2. Once the base of the cartridge reaches the rear edge of the barrel, ejectors are pressed forward and the first step of closing a wedge-type breechblock 26 is initiated. The rammer 9 and the loading tray 15 then move back to their starting positions, and the partition door 13 is also closed. At the same time, the breechblock 26 closes the tubular weapon 2 which is then able to move into firing position.

In case of power failure, the magazine belts 5 can be operated manually from the crew chamber by means of a crank drive. After manually opening the respective partition door 13, the ammunition can be pulled into the loading position by means of the loading tray 15, whereupon the cartridge 6 to be loaded can be pushed manually into the chamber 25.

Figure 3:
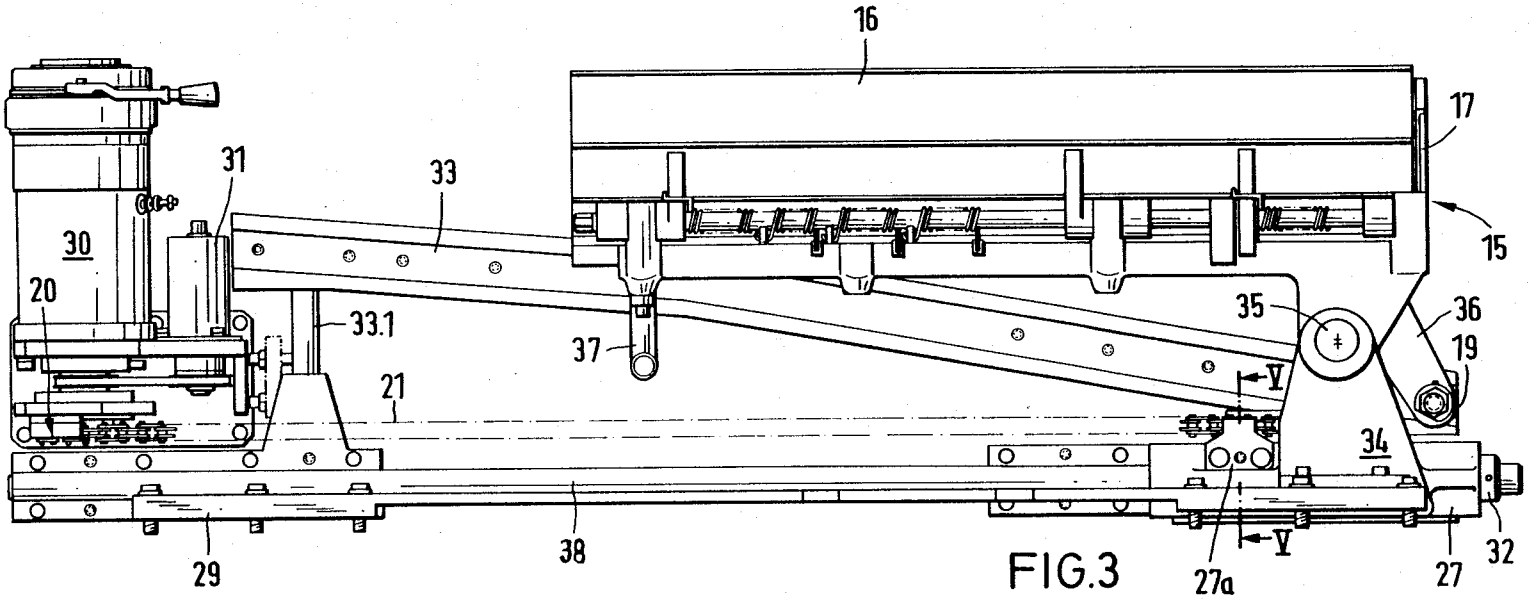
FIG. 3 is a top plan view of another preferred embodiment of the loading device according to the invention.
Figure 5:
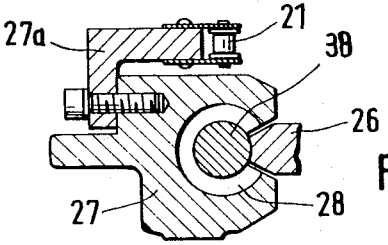
FIG. 5 is a sectional view along line V—V of FIG. 3.
Figure 4:
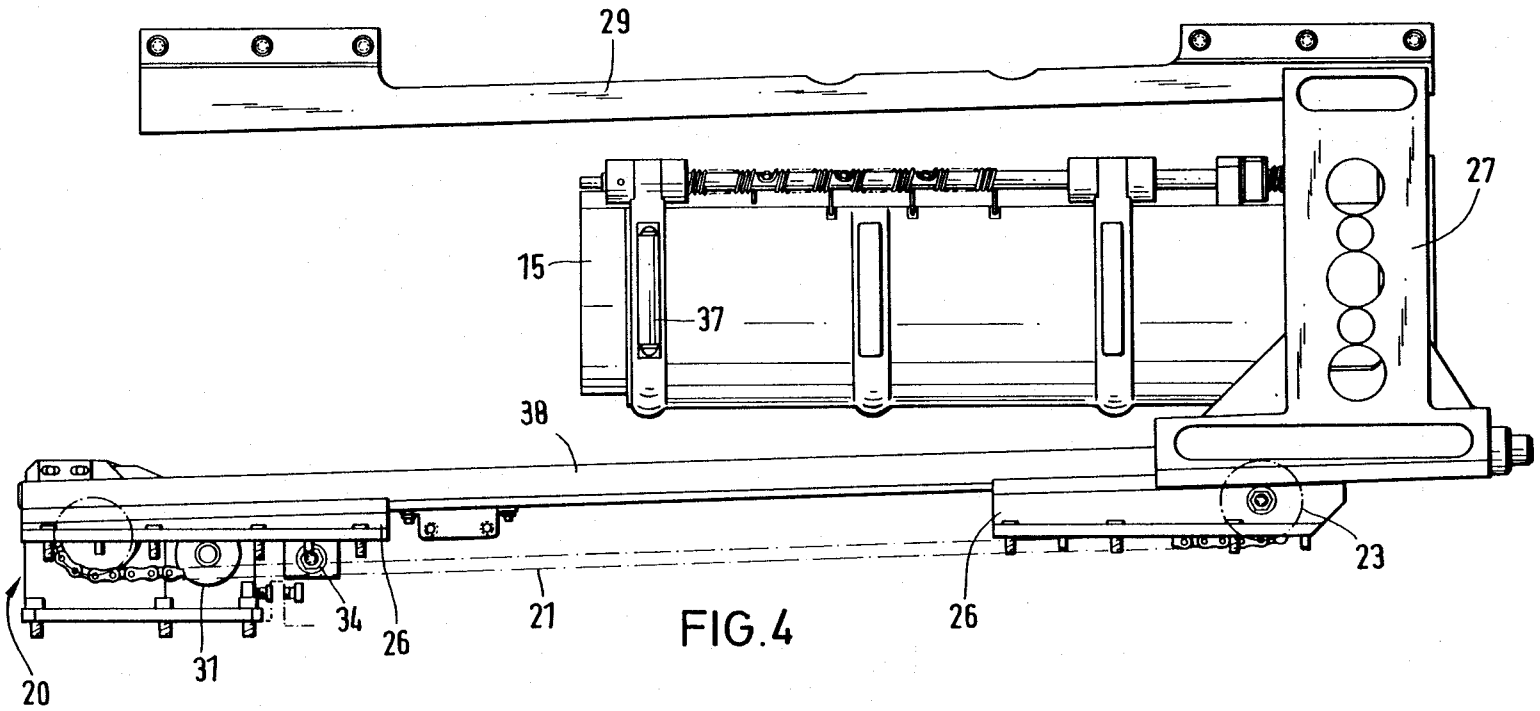
FIG. 4 is a front elevational view of the structure shown in FIG. 3.

Turning now to the embodiment shown in FIGS. 3, 4 and 5, a guide rod 38 which is fixed to the turret is provided as a straight guide and is supported by brackets 26. The guide rod 38 guides a carriage 27 at its underside. The carriage 27 is provided with a ball race sleeve 28 to reduce friction between the carriage 27 and the guide rod 38. The ball race sleeve 28 encloses guide rod 25 over part of its circumference. The upper edge of the carriage 27 is guided by a rail 29 which is fixed to the turret. The carriage 27 is connected with a chain 21 by means of an angle member 27*a*. The chain drive 20 includes a drive motor 30 and a displacement sensor 31. An abutment ring 32 for the carriage 27 may additionally be provided on the exterior of the guide rod 25.

In the embodiment shown in FIGS. 3–5 the curved guide is constituted by a guide rail 33 which is fixed to the turret and is curved toward the side of the magazine. The guide rail 33 is, if required, adjustable by a rod 33.1 to vary the distance of its interior distance from the tubular weapon 2.

On its side facing the belt magazines 3 and 4, respectively, the carriage 27 is provided with a fork 34 which accommodates a hinge pin 35 articulating the loading tray 15 to the carriage 27. The loading tray 15 is further provided with an arm 36 which bears at its end a roller 19 arranged to run on the guide rail 33. The articulations of the loading tray 15 to the carriage 27 and the arm 36 are disposed in the region of the respective outer end of the loading tray 15 on the side facing away from the respective belt magazine 3 or 4.

After the loading tray 15 receives a cartridge, the loading tray 15 is pulled inwardly by the chain drive 20, drawing the carriage 27 along the guide rod 38. At the same time, the engagement of the roller 19 with the guide rail 33 produces a pivoting motion in the direction toward the tubular weapon 2 until the loading tray 15 is aligned with the tubular weapon 2. Thereafter, the loading process is the same as in the preceding embodiment.

The partition wall which corresponds to the partition wall 12 of th previously described embodiment and which, similarly to the belt magazines and the rammer are not illustrated in FIGS. 3–5, may be disposed directly in front of the loading device, and the bracket 29 may be fastened to the partition wall. As in the preceding embodiment, the partition wall may be provided with partition doors which, however, are opened and closed preferably by means of their own drives. It is feasible, however, to provide instead a single partition door which for executing opening and closing movements, can be moved upward and downward, for example, by means of a toothed rack drive.

Similarly to the embodiment illustrated in FIGS. 1 and 2, the embodiment shown in FIGS. 3–5 too, may be manually operated. For this purpose the loading tray 15 is provided with a handle 37 to effect a manual swinging motion thereof.

The present disclosure relates to subject matter contained in Federal Republic of Germany Patent Application No. P 37 01 712.8 (filed Jan. 22, 1987) which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a loading device for a tubular weapon, including two adjacent belt magazines supporting cartridges such that tips of the cartridges in the one magazine are oriented to tips of cartridges in the other magazine; each magazine having a discharge side oriented toward the tubular weapon;

a rammer disposed between the two magazines and movable towards and away from said tubular weapon;

a separate loading tray cooperating with each magazine and being arranged for pivotal motion about 90° from a cartridge-receiving position adjoining the discharge end of a respective said belt magazine into a loading position in alignment with the tubular weapon; and means for guiding each said loading tray, at an outer end thereof, along the discharge end of the respective said magazine;

the improvement comprising (a) a common partition wall forming part of the two magazines and being arranged between said discharge sides and said tubular weapon; said loading position of said loading tray being situated on a side of said partition wall oriented away from the tubular weapon;

(b) two partition doors arranged side-by-side and being pivotally secured to said partition wall for pivotal motions towards and away from said tubular weapon; said partition doors having a first side oriented towards the magazines and a second side oriented towards said tubular weapon;

(c) separate drive chains supported along the discharge side of each magazine and being connected to a respective said loading tray for displacing said loading tray;

(d) power means for causing travel of said drive chains;

(e) a separate linear guide being pivotally connected with a respective said loading tray and being affixed to the first side of a respective said partition door; and (f) a separate curved guide extending generally along the discharge side of the respective said magazine and being sent theretoward; said linear guide and said curved guide together guiding the respective loading tray from one of said positions to the other of said positions when displaced by said drive chain.

2. A loading device as defined in claim 1, wherein each drive chain has a reach to which the respective tray is articulated; said reach of the drive chains being guided by and along a respective said curved guide; and further wherein said partition doors are arranged to execute opening and closing movements in response to forces exerted thereon by the respective said loading tray during pivotal motion thereof into said loading position and said cartridge receiving position, respectively.

3. A loading device as defined in claim 1, wherein each loading tray has an outer end articulated to a respective said drive chain.

4. A loading device as defined in claim 1, further comprising a displacement sensor operatively connected with said power means.

5. A loading device as defined in claim 1, further comprising a runner roller mounted on a respective said loading tray and rollingly engaging said linear guide.

6. A loading device as defined in claim 1, wherein each said loading tray comprises a half shell and a spring-biased cartridge holding clamp.

7. A loading device as defined in claim 1, further comprising partitions forming part of each magazine and flanking said rammer.

8. A loading device as defined in claim 1, further comprising a shield situated adjacent said partition wall in a mid zone thereof and extending between said magazines; said rammer traversing said shield.

9. In a loading device for a tubular weapon, including two adjacent belt magazines supporting cartridges such that tips of the cartridges in the one magazine are oriented to tips of cartridges in the other magazine; each magazine having a discharge side oriented toward the tubular weapon;

a rammer disposed between the two magazines and movable towards and away from said tubular weapon;

a separate loading tray cooperating with each magazine and being arranged for pivotal motion about 90° from a cartridge-receiving position adjoining the discharge end of a respective said belt magazine into a loading position in alignment with the tubular weapon; and means for guiding each said loading tray, at an outer end thereof, along the discharge end of the respective said magazine;

the improvement comprising (a) a common partition wall forming part of the two magazines and being arranged between said discharge sides and said tubular weapon; said loading position of said loading tray being situated on a side of said partition wall oriented away from the tubular weapon;

(b) two partition doors arranged side-by-side and being pivotally secured to said partition wall for pivotal motions towards and away from said tubular weapon; said partition doors having a first side oriented towards the magazines and a second side oriented towards said tubular weapon;

(c) separate drive chains supported along the discharge side of each magazine and being connected to a respective said loading tray for displacing said loading tray;

(d) power means for causing travel of said drive chains;

(e) a stationarily mounted separate linear guide being in guiding engagement with said loading tray;

(f) a stationarily mounted separate curved guide extending generally along the discharge side of the respective said magazine and being bent theretoward; said linear guide and said curved guide together guiding the respective loading tray from one of said positions to the other of said positions when displaced by said drive chain; and (g) a separate carriage connected to and movable by a respective said drive chain; each said loading tray being pivotally connected to a respective said carriage; said carriage being guided by and along said linear guide.

10. A loading device as defined in claim 9, wherein said linear guide comprises a guide rod; further comprising coupling means attached to said carriage and partially surrounding said guide rod.

11. A loading device as defined in claim 10, wherein said coupling means comprises a ball race sleeve.

* * * * *